United States Patent [19]

Deal

[11] Patent Number: 4,612,752

[45] Date of Patent: Sep. 23, 1986

[54] CARTON FLAP FOLDING ASSEMBLY FOR CIGARETTE CARTONS

[75] Inventor: Philip A. Deal, Winston-Salem, N.C.

[73] Assignee: R. J. Reynolds Tobacco Company, Winston-Salem, N.C.

[21] Appl. No.: 782,087

[22] Filed: Sep. 30, 1985

[51] Int. Cl.[4] ..... B65B 7/26

[52] U.S. Cl. ..... 53/377; 53/382

[58] Field of Search ..... 53/226, 374, 377, 381 R, 53/382

[56] References Cited

U.S. PATENT DOCUMENTS

| | | | |
|---|---|---|---|
| 3,032,947 | 5/1962 | Voller | 53/374 X |
| 3,662,516 | 5/1972 | Wiseman | 53/382 X |
| 4,523,422 | 6/1985 | Ilesmann | 53/382 X |

*Primary Examiner*—John Sipos

*Assistant Examiner*—Steven P. Weihrouch

*Attorney, Agent, or Firm*—Grover M. Myers

[57] ABSTRACT

A carton flap folding assembly, particularly intended for use with single tuck flap cigarette cartons, uses a hinged upper plate provided with vacuum ports to elevate a major carton face. A lower tucker blade raises the flap face of the single carton flap and an upper tucker blade, which is carried at the end of a rotatable upper tucker arm, folds or tucks a flap edge portion of the single flap into the space between the surface of the upper cigarette pack row and the elevated major carton face. The upper tucker blade and arm are rotated out of the space in the carton while the upper hinge plate lowers the major carton face and releases it. The flap edge of the single tuck face is thereby held between the pack surface and the carton wall to close the carton.

12 Claims, 5 Drawing Figures

CARTON FLAP FOLDING ASSEMBLY FOR CIGARETTE CARTONS

FIELD OF THE INVENTION

The present invention is directed generally to a carton flap folding assembly. More particularly, the present invention is directed to a carton flap folding device for folding cigarette carton flaps. Most specifically, the present invention is directed to a cigarette carton flap folding machine usable to assemble a single, tuck flap cigarette carton. The carton folding assembly receives a plurality of cigarette packs which are wrapped by a carton blank as they are plunged into a receptacle in the carton folder. A hinged, upper carton body engaging plate lifts the upper carton body while a bottom tucker arm folds the carton flap upwardly and an upper tucking blade folds the free end of the flap inwardly. As the upper tucking blade retracts, the hinged plate descends to close the carton.

DESCRIPTION OF THE PRIOR ART

Cigarettes are typically placed in packs which are then inserted into cartons. In a conventional arrangement, 10 of these packs of cigarettes are placed in a carton by various generally well known cartoning machines. Typically, these cartoning machines will have a recess or receptacle into which the ten packs of cigarettes are forced by a plunger. A generally flat, unfolded cigarette carton blank is interposed between the ten packs of cigarettes and the recess in the cartoning machine. The motion of the cigarette packs into the recess folds the previously flat carton blank around the ten pack array of cigarettes. After the carton blank has been folded into a generally U-shaped configuration about the packs in the recess of the folding assembly, the end flaps of the carton blank are folded and sealed and the double top flaps are folded and sealed. This is accomplished by a pair of upper and lower tucker arms that fold the two face flaps of the carton blank over each other. A strip or band of glue is interposed between the two face flaps prior to folding and this glue or other adhesive secures the flaps together to close the carton before it leaves the cigarette manufacturer.

Most states, and numerous other jurisdictions such as counties and cities, levy taxes on the sale of cigarettes as a means to raise revenue. A tax stamp must often be applied to the bottom of each pack of cigarettes as evidence that the tax has been paid. Since the stamps vary from jurisdiction to jurisdiction, it is virtually impossible for the cigarette manufacturer to apply the tax stamps to the cigarette cartons. This process falls to the regional distributor or jobber. Tax stamping machines are generally well known for use in automatically unsealing, tax stamping and resealing cartons of cigarettes having a generally conventional configuration of two five cigarette pack rows in each carton. However, a problem arises when a non-standard pack configuration carton, such as may occur with the introduction of a different sized cigarette or different sized cigarette pack, must be tax stamped. Such non-standard size cigarette cartons cannot be used with the generally well known automatic tax stamping equipment but must be unsealed, tax stamped, and resealed manually. In order to gain access to the cigarette packs so that the tax stamps can be manually or otherwise applied to them, it is of course necessary to unseal the two face flaps of the previously sealed carton. A problem frequently arises when this is done by hand. The cigarette manufacturer glued the flaps closed when he manufactured the carton of cigarettes and applied sufficient glue to secure the flaps together. The jobber or distributor, in attempting to open the glued flaps, may rip one of the face flaps or may pull the facing paper off the carton. Either situation presents a problem which the distributor or jobber must deal with. The retailer does not want a carton that has been ripped or torn since the consumer may not accept it. Therefore, the distributor or jobber may find it necessary to maintain an inventory of carton blanks so that he can replace the torn carton with a new one. Such repacking of the cigarettes into a new carton by hand takes time and increases the jobber's cost. A reduction of the amount of glue used to seal the carton flaps would reduce the incidence of carton damage and thus would be acceptable to the jobber, but would increase the incidence of carton opening during packing and shipping and would be unacceptable to the manufacturer.

One possible solution is the use of a cigarette carton that does not have overlappingly adhered face flaps but instead has a single face flap that is of the tuck flap variety. This type of flap is inserted into the body of the carton and underlies one of the major body panels of the carton. No glue or other sealant is required and the carton is easily opened by the jobber or distributor for tax stamping without the risk of carton damage inherent with the glue sealed flaps of the conventional carton. The major drawback of the single, tuck flap carton is that it requires a different type of carton flap folding assembly. Such carton flap folders are not inexpensive and often the cigarette manufacturer and jobber do not have this capability. Thus they cannot use the tuck flap carton.

A need exists for a carton folding assembly which will operate with single tuck flap carton blanks and which can be adapted to presently used double flap carton folder assemblies. The cigarette flap carton folder assembly in accordance with the present invention provides such a device.

SUMMARY OF THE INVENTION

It is an object of the present invention to provide a carton flap folding assembly.

Another object of the present invention is to provide a cigarette carton flap folder.

A further object of the present invention is to provide a cigarette carton flap folder usable with a single tuck flap carton blank.

Still another object of the present invention is to provide a tuck flap cigarette carton flap folding assembly adaptable to a generally conventional double flap folding assembly.

Yet a further object of the present invention is to provide a carton flap folding assembly having a vacuum carton face pick up plate.

Even still another object of the present invention is to provide a carton flap folding assembly having an upper tucking blade.

Yet still a further object of the present invention is to provide a carton flap folding assembly having a hinged carton face pick up plate.

As will be discussed in greater detail in the description of the preferred embodiment which is set forth in detail hereinafter, the carton flap folding assembly for cigarette cartons in accordance with the present invention is intended for use to fold a single tuck flap cigarette carton. The carton blank is interposed between an array of cigarette packs and the pack and carton blank receiving recess in a carton flap folder. As the packs are plunged into the recess, the blank is formed about the packs in a generally conventional manner. The upper plate of the receiving recess is hinged or pivoted at its inner end and is provided with vacuum ports. The upper main face of the carton is pulled against this plate by vacuum and the plate and carton face are raised up from the upper surface of the upper row of cigarette packs by a pivot arm. A bottom tucker arm folds the single carton flap upwardly and an upper tucker blade tucks the free end of the flap into the space between the undersurface of the upper main carton face and the upper surface of the upper row of cigarette packs. As the upper tucker blade retracts out of the space, the pivoting plate descends to close the carton.

The carton flap folding assembly in accordance with the present invention allows single tuck flap cartons to be closed in an expeditious manner. These cartons are closed securely enough to be handled by the manufacturer during carton case loading. When the cartons arrive at the distributor or jobber's facility, they can easily be opened for tax stamp application without any carton damage. Since there is no glue seam or line to be broken but instead only a flap to be untucked, there is virtually no possibility of carton damage. Once the cigarette packs in each carton have been stamped, the single tuck flap can again be tucked into the carton or alternatively can be glued to the main face of the carton, either interiorly or exteriorly thereof. Such reclosure can be done by the distributor or jobber utilizing a carton flap folder in accordance with the present invention or alternatively can be accomplished manually.

The carton flap folding assembly for cigarette cartons in accordance with the present invention is usable with presently utilized double flap carton folding assemblies. These conventional double flap folders are modified in a relatively inexpensive manner so that the single tuck flap folder of the present invention does not require the use of completely new equipment. Thus a substantial capital expenditure is avoided while still providing a carton flap folder which forms a securely closed carton without the use of glue sealing. It is thus readily adaptable to large scale usage without unduly high cost.

BRIEF DESCRIPTION OF THE DRAWINGS

While the novel features of the carton flap folding assembly for cigarette cartons in accordance with the present invention are set forth with particularity in the appended claims, a full and complete understanding of the present invention may be had by referring to the description of the preferred embodiment which is set forth subsequently, and as may be seen in the accompanying drawings in which:

DESCRIPTION OF THE PREFERRED EMBODIMENT

Figure 1:
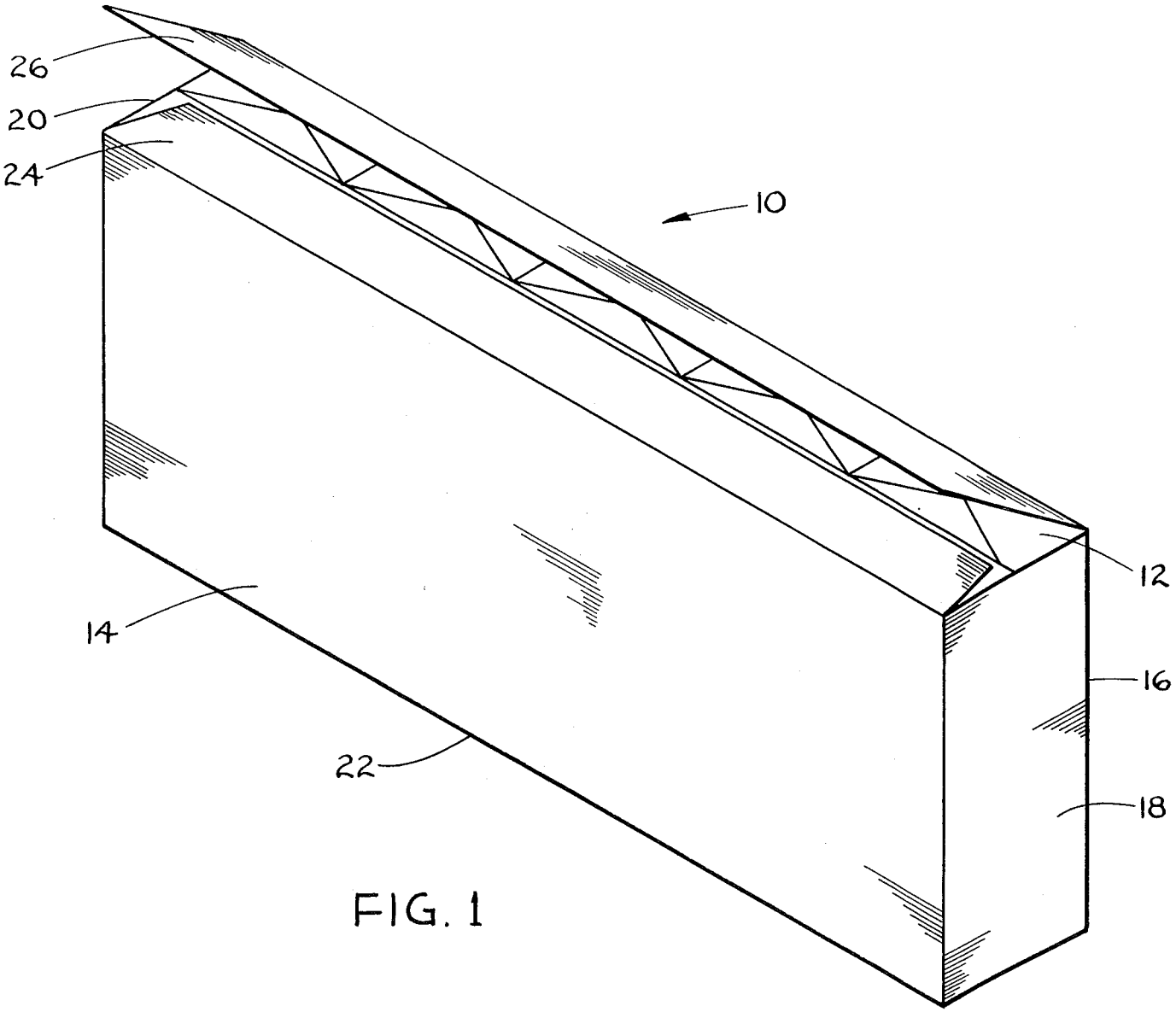
FIG. 1 is a perspective view of a double flap top cigarette carton.
Figure 2:
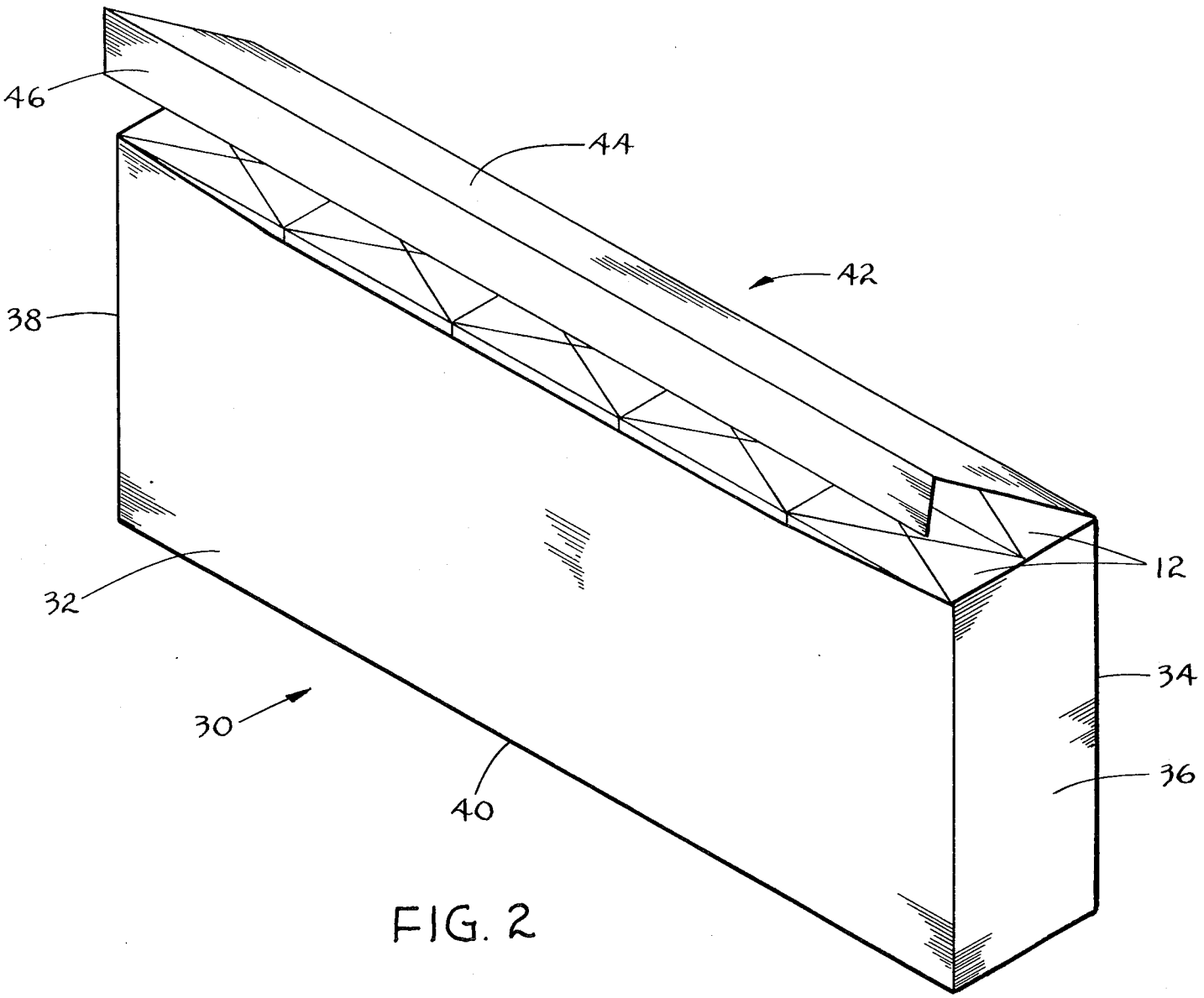
FIG. 2 is a perspective view of a single tuck flap cigarette carton.

Referring initially to FIG. 1 there may be seen generally at 10 a double top flap cigarette carton as is widely used in the industry. Carton 10 typically holds ten packs of cigarettes 12 in a conventional 2 pack wide by 5 pack long configuration (referred to as a 2×5 carton). Carton 10 includes spaced major faces 14, and 16, end walls 18 and 20, a bottom wall 22, and an inside top flap 24 and an outside top flap 26. A single, tuck flap cigarette carton may be seen generally at 30 in FIG. 2. Carton 30 also has spaced major walls 32 and 34, end walls 36 and 38, and a bottom wall 40 in a manner the same as double top flap carton 10. However, single tuck flap carton 30 is closed by a single top flap, generally at 42 which is formed having a flap face 44 and a flap edge 46. As is readily apparent, carton 30 is closed by insertion of flap edge 46 into the space between major carton face 32 and the outer surface of the adjacent row of cigarette packs 12. In contrast, the double top flap carton 10 requires the use of a suitable glue applied to either the outer surface of inside top flap 24 or the inner surface of outer top flap 26 to secure the two flaps together, thereby sealing the carton. As was discussed previously, the use of a glue seal to close the carton 10 may present problems when the carton 10 must subsequently be opened for the application of tax stamps to the bottom surfaces of the packs of cigarettes 12 carried within the cartons.

Figure 3:
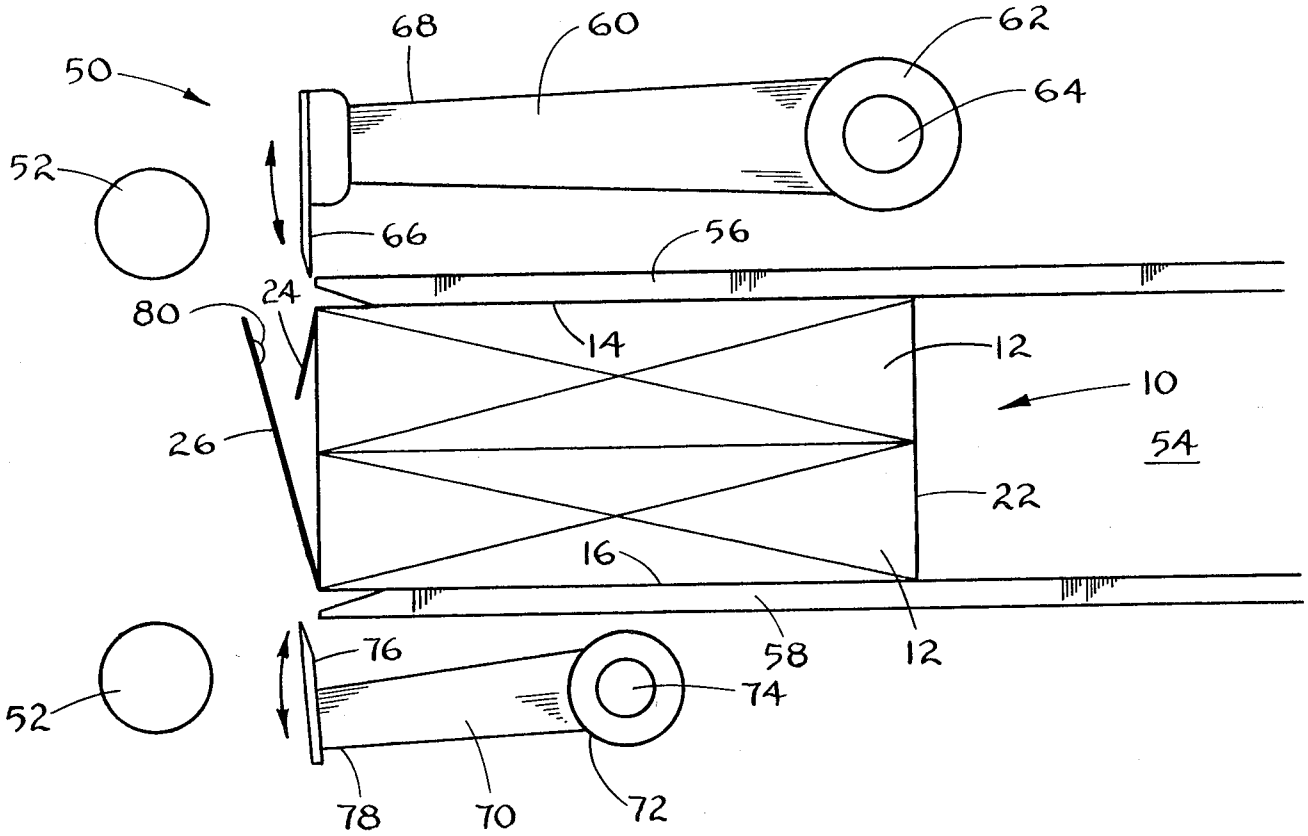
FIG. 3 is a schematic side elevation view, partly in section of a prior art double flap cigarette carton folding assembly.

Turning now to FIG. 3, there may be seen generally at 50 a conventional cartoning machine such as is manufactured by Molins Machinery and others. This cartoning assembly is intended for use with a double top flap carton 10 as is depicted being folded by cartoning machine 50. A typical 2×5 cigarette pack configuration is formed exteriorly of the cartoning machine 50 and a carton blank (not shown) which will become double top flap carton 10 is interposed between the pack configuration and a pair of spaced rollers 52. A suitable plunger (not shown) forces the packs against the carton blank and then pushes both the packs and carton blank between the spaced upper and lower rollers 52 into a receptacle or recess 54 in the cartoning machine 50 formed between spaced upper and lower fixed plates 56, 58, respectively. An upper tucker arm 60 is secured at a first end 62 to an upper shaft 64 and is rotated thereabout by conventional means not shown. Upper tucker arm 60 carries an upper folding blade 66 at a second end 68. This upper folding blade 66 engages the inside top flap 24 of carton 10 and folds it down against the bottom surface of the cigarette packs 12. A lower tucker arm 70, which is attached at a first end 72 to a lower shaft 74 and which is also rotated thereabout by conventional means (not shown), carries a lower foldin9 blade 76 at a second end 78 thereof, immediately folds the outside top flap 26 over the now folded inside top flap 24. A line of glue 80, which has been applied to the inner surface of the outside top flap 26 in a conventional manner (not shown) seals the outside top flap 26 to the inside top flap 24 by the pressure exerted by lower folding blade 76. Since this cartoning machine 50 is generally well known in the art and since it is set forth here primarily for comparative purposes, no further discussion thereof is believed necessary.

Figure 4:
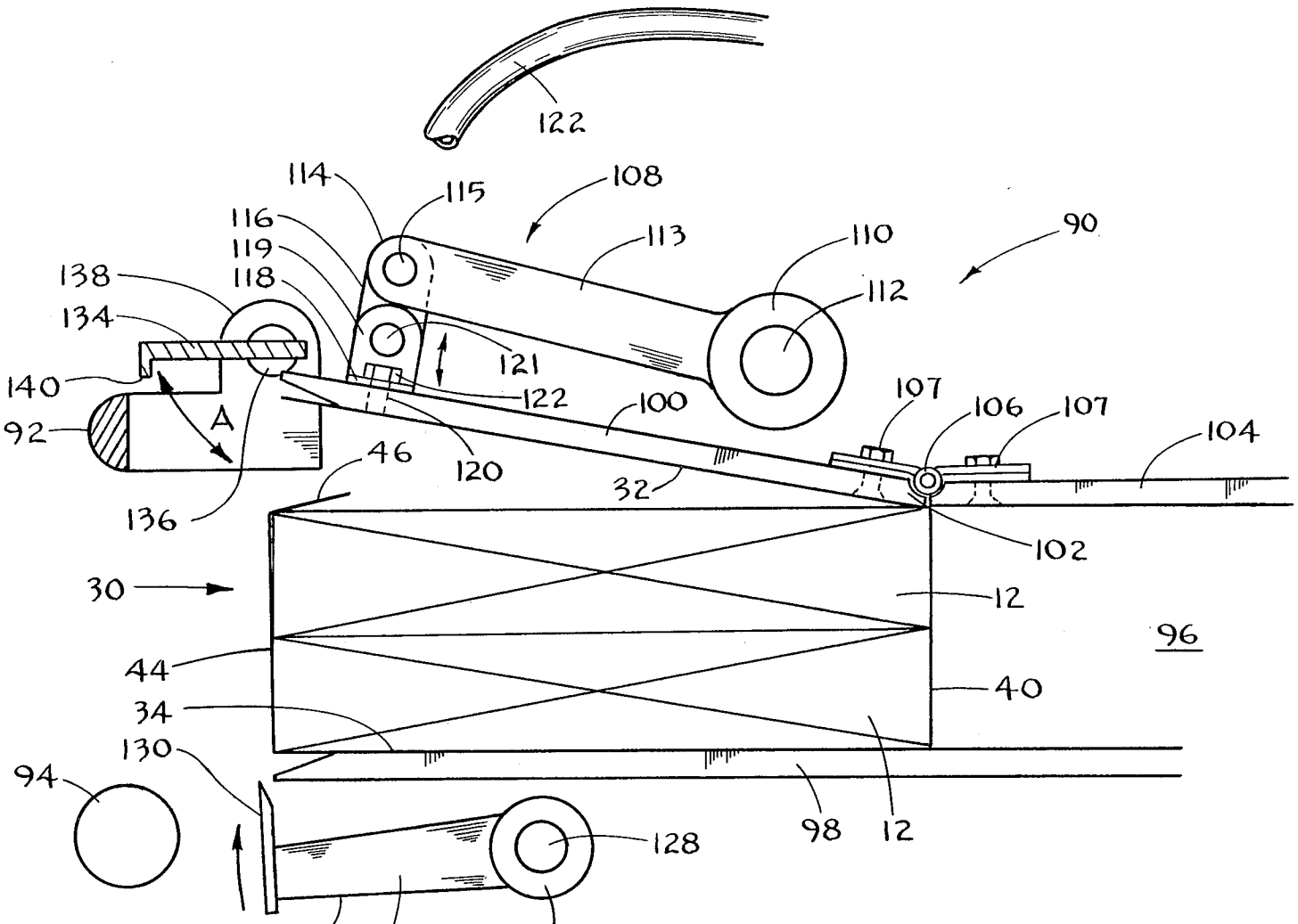
FIG. 4 is a schematic side elevation view, partly in section of a carton flap folding assembly for cigarette cartons in accordance with the present invention.

Referring now to FIG. 4, there may be seen generally at 90 a somewhat schematic presentation of the carton flap folding assembly for cigarette cartons in accordance with the present invention. This carton flap folding assembly is structured to fold a single tuck flap carton 30, as may be seen in FIGS. 2 and 4. In a manner similar to the prior art cartoning machine 50, a 2×5 cigarette pack configuration is formed exteriorly of carton flap folding assembly 90 and a carton blank (not shown), which will become a single tuck flap carton 30, is interposed between the pack array and folding assembly 90. A suitable plunger (not shown) forces the packs 12 against the blank and then the packs 12 and blank between an upper semi-round fixed bar 92 and a spaced lower roller 94. The carton blank and packs 12 are forced into a recess or receptacle 96 in carton flap folding assembly 90 defined by a lower fixed plate 98 and an upper hinged plate 100. Upper hinged plate 100 is attached at a first, inner end 102 to a fixed upper plate 104 by a hinge assembly 106, shown somewhat schematically in FIG. 4, which is attached to hinged plate 100 and to upper plate 104 by flat screws and nuts generally at 107.

Hinged upper plate 100 is capable of being pivoted or raised and lowered about hinge 106 by an upper lifting arm assembly 108 which is attached at a first end 110 to a rotatable upper shaft 112. A pair of spaced, parallel upper lifting arms 113 extend forwardly from first end 110 of lifting arm assembly 108 to second or outboard ends 114. A pivot link arm 116 is positioned between outboard ends 114 of upper lifting arms 113 and is pivotable about an upper pin 115 which passes through aligned apertures in arms 113 and the upper portion of pivot link arm 116. A flange plate 118 is secured to the upper surface of upper hinged plate 110, generally beneath the outboard ends 114 of upper lifting arms 113. Flange plate 118 carries a pair of spaced, upwardly extending, apertured ears 119. The lower end of pivot link arm 116 is positioned between ears 119 and is pivotably affixed thereto by a lower pin 121 which passes through the aligned apertures in ears 119 and a corresponding aperture in the lower end of pivot link arm 116. Rotation of shaft 112 will thus cause upper plate 100 to be raised and lowered about hinge 106.

Several vacuum ports 120 are formed in upper hinged plate 100 generally adjacent its free end and these ports are connected by flexible tubing 122 to a source of vacuum. Application of vacuum to ports 120 causes the major wall 32 of carton 30 to engage the undersurface of upper hinge plate 100 and to move upwardly with it, as may be seen in FIG. 4.

As the 2×5 pack configuration and the blank that will become single tuck flap carton 30 are plunged into recess 96, a lower tucker arm 124, similar to lower tucker arm 70 of FIG. 3, that is attached at a first end 126 to a rotatable shaft 128 and carries a lower folding blade 130 at a second end 132, moves upwardly so that lower folding blade 130 engages the flap face 44 of carton 30 and starts to move it upwardly and inwardly. At the same time, vacuum is applied to vacuum ports 120 and upper hinge plate 100 is raised by rotation of upper shaft 112. This lifts the major carton face 32 up off the upper surface of the upper row of cigarette packs 12 in the carton 30. An upper tucker arm 134 is attached at its ends to a pair of rotatable stub shafts 136 carried by spaced journal blocks 138 to which the ends of the fixed semi-round bar 92 are secured. An upper tucker blade 140 is carried at the free end of upper tucker arm 134 and as this upper arm rotates downwardly in a counterclockwise direction, as indicated by arrow A in FIG. 4, the upper tucker blade 140 contacts the outer surface of flap edge 46 and folds it inwardly into the space between the upper surface of the upper row of cigarette packs 12 and the now elevated undersurface of major carton face 32. As the upper tucker arm's direction is reversed and it moves back to a position such as is shown in FIG. 4, the upper hinged plate is lowered and the vacuum is released from ports 120. This effectively closes the carton since the flap edge 46 of the single tuck flap 42 is captured between the upper cigarette pack surface and the major face 32. However, since no glue is required for carton closure, the carton can easily be opened by the distributor or jobber for tax stamping merely by pulling the single tuck flap 42 out. After the cigarette packs have been tax stamped, the flap edge 46 can again be inserted back into the carton beneath major face 32 or alternatively can be glued to the exterior face of major face 32 by any suitable means.

Figure 5:
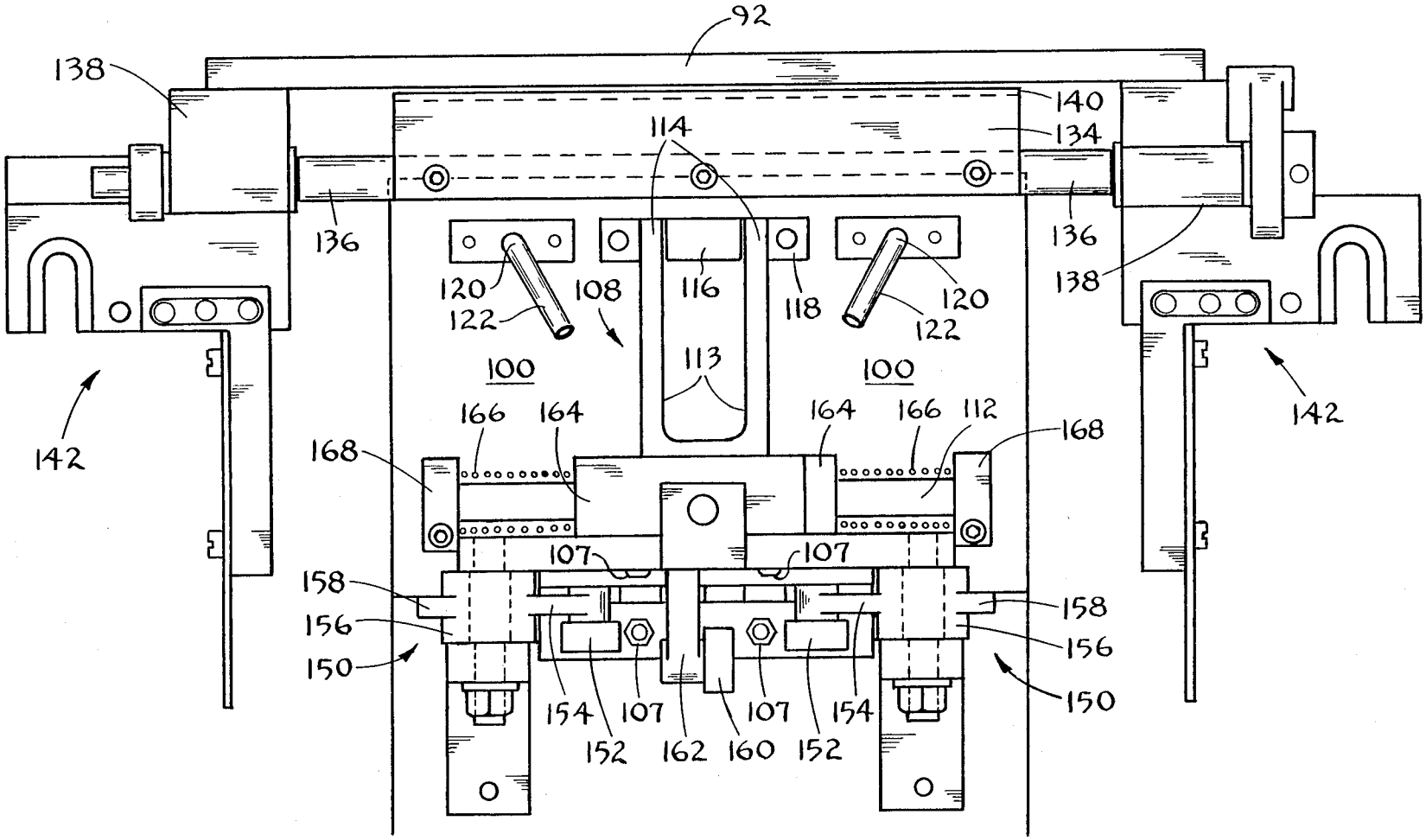
FIG. 5 is a top plan view of the carton flap folding assembly of the present invention.

As was discussed previously, the carton flap folding assembly for cigarette cartons in accordance with the present invention is intended for use as an adaptation to or a modification of a generally well known Molins Manufacturing cartoning machine. Through the use of the carton flap folding assembly of the present invention, a standard Molins double flap cartoning assembly can be adapted for use as a single tuck flap carton folder. Referring now to FIG. 5 there may be seen a generally conventional Molins cartoning machine adapted in accordance with the present invention. Upper hinged plate 100 is raised and lowered by upper lifting arm assembly 108 that is attached to shaft 112. Flange plate 118 is secured to the top of upper hinge plate 100, as may be seen in FIG. 5. Vacuum ports 120 are supplied vacuum through the flexible hoses 122. The upper tucker arm 134, with its downwardly extending upper tucker blade 140, is attached at either end to rotating stub shafts 136 supported in journal blocks 138. The fixed upper semi-round bar 92 is attached at either end to journal blocks 138 and extends therebetween generally in front of upper tucker arm 134. Suitable mounting means 142 are utilized to secure the carton flap folding assembly in accordance with the present invention to the conventional Molins support structure.

A pair of end carton flap folding arms are also provided in folding machines. Since they are conventional and do not change in the present invention, they are not specifically discussed. However, as may be seen in FIG. 5 actuating means for these end flap closures are shown generally at 150. These include end flap cam followers 152 which are attached to arms 154 which extend from central journal hubs 156. End flap closure actuating arms 158 extend out from hubs 156. Cam induced motion of cam followers 152 operates the end flap closure means. In a similar manner, a hinged plate cam follower 160 is positioned between the end flap cam followers 154 and is carried at the end of an arm 162. The opposite end of this arm 162 is secured to rotatable upper shaft 112 which is carried by bearings 164 at its outer ends. A downward force exerted on cam follower 160 by a cam plate (not shown) will cause upper hinge plate 100 to rise, as was set forth with the discussion of FIG. 4, thereby lifting up the major carton face 32 so that the upper tucker blade 140 can tuck the flap edge 46 in place. It will be understood that suitable drive means will be provided for one or both of the upper tucker arm supporting rotatable stub shafts 136 and that the motions of the lower tucker arm 124, the upper hinge plate arm assembly 108 and the upper tucker arm 134 will be coordinated to operate in the proper sequence. Such control cams and drive means are generally well known in the art and are not a part of the subject invention.

A torsion spring 166 is placed about shaft 112, as is shown in cross section in FIG. 5 for clarity. This spring is held about shaft 112 by clamp collars 168 that serve to adjust the spring tension on spring 166 as the spring is held between the bearing blocks 164 and the clamp collars 168.

While a preferred embodiment of a carton flap folding assembly particularly intended for use with single tuck flap cigarette cartons has been fully and completely disclosed hereinabove, it will be obvious to one of skill in the art that a number of changes in, for example, the various cam drives, the types of materials used, the pack orientation in the carton and the like could be made without departing from the true spirit and scope of the subject invention which is accordingly to be limited only by the following claims.

What is claimed:

1. A carton flap folding assembly for use with single, tuck flap cigarette cartons, said carton flap folding assembly comprising:

spaced upper and lower plates defining a cigarette carton receiving recess, a portion of said upper plate being hinged for movement with respect to said lower plate;

means to raise and lower said upper hinged plate;

means to releasably secure to said upper hinged plate a major face of a carton positioned in said carton receiving recess while said hinged plate is being raised to raise said major carton face;

lower tucking means to raise a single tuck flap portion of said carton; and upper tucking means to tuck a flap edge of said single tuck flap beneath said the raised major face of said carton to close said carton.

2. The carton flap folding assembly of claim 1 wherein said upper hinged plate is hinged at a first end to a fixed upper plate and has a movable second end adjacent the entrance of said carton receiving recess.

3. The carton flap folding assembly of claim 2 wherein said means to raise and lower said upper hinged plate includes an upper lifting arm assembly.

4. The carton flap folding assembly of claim 3 wherein said upper lifting arm assembly is attached at a first end to a rotatable upper shaft.

5. The carton flap folding assembly of claim 4 wherein said rotatable upper shaft is positioned generally adjacent said hinged first end of said upper hinged plate.

6. The carton flap folding assembly of claim 4 wherein a second end of said upper lifting arm assembly is attached to said upper hinged plate through a pivoted link arm.

7. The carton flap folding assembly of claim 6 wherein said pivoted link arm extends between said second end of said upper lifting arm assembly and a flange plate secured to said second end of said upper hinged plate.

8. The carton flap folding assembly of claim 1 wherein said means to releasably secure said major carton face to said upper hinged plate includes at least one vacuum port formed in said upper hinged plate.

9. The carton flap folding assembly of claim 1 wherein said lower tucking means includes a lower tucking arm attached at a first end to a lower rotatable shaft and having a lower folding blade at a second end, said lower folding blade being adapted to elevate and fold a flap face of the single tuck flap cigarette carton.

10. The carton flap folding assembly of claim 1 wherein said upper tucking means includes an upper tucker arm secured at its ends to rotatable stub shafts.

11. The carton flap folding assembly of claim 10 wherein said upper tucker arm includes an upper tucker blade, said upper tucker blade being capable of engaging said flap edge of said single tuck flap carton.

12. The carton flap folding assembly of claim 1 further including a semi-round bar and a spaced roller, said bar and roller being positioned adjacent said upper plate and said lower plate, respectively, and generally transverse to said carton receiving recess.

* * * * *